US009753417B2

(12) United States Patent
Yamaguchi et al.

(10) Patent No.: US 9,753,417 B2
(45) Date of Patent: Sep. 5, 2017

(54) FIXING DEVICE INCLUDING OUTLET GUIDE MEMBER AND IMAGE FORMING APPARATUS THEREOF

(71) Applicants: Yoshiki Yamaguchi, Kanagawa (JP); Yoshio Hattori, Kanagawa (JP); Haruyuki Honda, Kanagawa (JP); Ryuuichi Mimbu, Kanagawa (JP); Toshihiko Shimokawa, Kanagawa (JP); Yutaka Ikebuchi, Kanagawa (JP); Yasunori Ishigaya, Kanagawa (JP); Kazuya Saito, Kanagawa (JP); Keitaro Shoji, Kanagawa (JP); Ryohei Matsuda, Kanagawa (JP)

(72) Inventors: Yoshiki Yamaguchi, Kanagawa (JP); Yoshio Hattori, Kanagawa (JP); Haruyuki Honda, Kanagawa (JP); Ryuuichi Mimbu, Kanagawa (JP); Toshihiko Shimokawa, Kanagawa (JP); Yutaka Ikebuchi, Kanagawa (JP); Yasunori Ishigaya, Kanagawa (JP); Kazuya Saito, Kanagawa (JP); Keitaro Shoji, Kanagawa (JP); Ryohei Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/070,735

(22) Filed: Mar. 15, 2016

(65) Prior Publication Data

US 2016/0274516 A1 Sep. 22, 2016

(30) Foreign Application Priority Data

Mar. 19, 2015 (JP) ..... 2015-056600

(51) Int. Cl.
*G03G 15/00* (2006.01)
*G03G 15/20* (2006.01)

(52) U.S. Cl.
CPC ..... *G03G 15/2053* (2013.01); *G03G 15/2028* (2013.01); *G03G 15/6573* (2013.01);
(Continued)

(58) Field of Classification Search
CPC ..... G03G 15/2053; G03G 15/6573; G03G 15/6576; G03G 2215/0043;
(Continued)

(56) References Cited

U.S. PATENT DOCUMENTS 5,555,083 A * 9/1996 Kuo ..... B65H 5/025 162/197
7,641,193 B2 * 1/2010 Barinaga ..... B21D 5/14 271/272

(Continued)

FOREIGN PATENT DOCUMENTS

JP 08175733 A * 7/1996
JP 2003270981 A * 9/2003

(Continued)

*Primary Examiner* — Robert Beatty
(74) *Attorney, Agent, or Firm* — Harness, Dickey & Pierce P.L.C.

(57) ABSTRACT

A fixing device includes an endless fixing belt; a pressure roller to contact the fixing belt; a nip forming member to press the pressure roller from the fixing belt; a nip portion formed between the fixing belt and the pressure roller; a heater to heat the fixing belt to fuse and fix toner onto a recording sheet in the nip portion; an auxiliary driven roller; an auxiliary drive roller to drive the driven roller; an auxiliary nip portion, formed between an outer circumferential surface of the auxiliary driven roller and an outer circumferential surface of the auxiliary drive roller, to nip the recording sheet after toner fixation conveyed from the nip portion; and an outlet guide member, disposed down- (Continued)

stream of the auxiliary nip portion, to guide the recording sheet after toner fixation conveyed from the auxiliary nip portion, with the toner-fixed recording sheet surface bent in a concave shape.

19 Claims, 5 Drawing Sheets

(52) U.S. Cl.
CPC ..... *G03G 2215/00421* (2013.01); *G03G 2215/2035* (2013.01)

(58) Field of Classification Search
CPC ..... G03G 2215/00662; G03G 2215/00421; G03G 2215/00704; G03G 2215/007
USPC ..... 399/329, 405, 406
See application file for complete search history.

(56) References Cited

U.S. PATENT DOCUMENTS 8,204,430 B2 * 6/2012 Baek ..... G03G 15/6573 271/207
8,761,657 B2 * 6/2014 Suzuki ..... B65H 29/22 399/397
9,395,674 B2 * 7/2016 Murooka ..... G03G 15/6576
2003/0007817 A1 * 1/2003 Saitoh ..... G03G 15/6576 399/406
2006/0165455 A1 * 7/2006 Kajita ..... G03G 15/6576 399/406
2007/0231024 A1 * 10/2007 Inomata ..... G03G 15/6573 399/322
2007/0269246 A1 * 11/2007 Tomatsu ..... G03G 15/6576 399/401
2009/0116883 A1 * 5/2009 Masaki ..... G03G 15/6552 399/315
2009/0238615 A1 * 9/2009 Katabami ..... G03G 15/2028 399/323
2010/0086332 A1 * 4/2010 Aratachi ..... G03G 15/2028 399/323
2011/0222926 A1 * 9/2011 Ueno ..... G03G 15/2028 399/328
2015/0147104 A1 * 5/2015 Miwa ..... G03G 15/6552 399/405
2016/0274508 A1 * 9/2016 Honda ..... G03G 15/2028
2016/0274509 A1 * 9/2016 Honda ..... G03G 15/2028
2016/0274513 A1 * 9/2016 Yamaguchi ..... G03G 15/2053

FOREIGN PATENT DOCUMENTS

JP 2008-122520 5/2008
JP 2008-137196 6/2008
JP 2009057202 A * 3/2009

* cited by examiner

FIXING DEVICE INCLUDING OUTLET GUIDE MEMBER AND IMAGE FORMING APPARATUS THEREOF

CROSS-REFERENCE TO RELATED APPLICATION

The present application claims priority pursuant to 35 U.S.C. §119(a) from Japanese patent application number 2015-056600, filed on Mar. 19, 2015, the entire disclosure of which is incorporated by reference herein.

BACKGROUND

Technical Field

The present invention relates to a fixing device and an image forming apparatus including the same.

Background Art

In an image forming apparatus employing electrophotography, an electrostatic latent image is first formed on a surface of a photoconductor, the electrostatic latent image is developed by toner as a developer and is rendered visible as a toner image, the developed toner image is transferred to a recording sheet by a transfer device, and subsequently, the image is fixed onto the recording sheet as a final image by a fixing device.

A typical fixing device includes a pressure belt, a heating roller that contacts an outer circumferential surface of the pressure belt, a pressure pad that presses the pressure belt against the outer circumferential surface of the heating roller from an internal circumferential surface of the pressure belt, and a heater to heat the heating roller.

Such a fixing device is configured such that the heating roller is driven to rotate, the pressure belt is driven by the rotation of the heating roller, and when a recording sheet on which a toner image is transferred is passed between the pressure belt and the heating roller with the heating roller heated by the heater, the toner image is fused and fixed onto the recording sheet.

However, the recording sheet heated at the nip portion curls sharply toward a side on which no image is formed, due to a difference in temperature between the side of the recording sheet on which the image is formed and on which the toner image is fused and fixed by the heating roller, on the one hand, and the side on which no image is formed and supported by the pressure belt on the other. If the curl amount of the recording sheet is prominent, a paper jam may occur in a sheet feeding path or a sheet ejection outlet of the image forming apparatus.

SUMMARY

In one embodiment of the disclosure, provided is an optimal fixing device including an endless fixing belt; a pressure roller to contact an outer circumferential surface of the fixing belt; a nip forming member to press the fixing belt against an outer circumferential surface of the pressure roller from an inner circumferential surface of the fixing belt; a nip portion formed between the outer circumferential surface of the fixing belt and the outer circumferential surface of the pressure roller; a heater to heat the fixing belt to fuse and fix toner onto a recording sheet in the nip portion; an auxiliary driven roller, disposed downstream of the nip portion in a recording sheet feeding direction; an auxiliary drive roller to drive the driven roller, disposed downstream of the nip portion in the recording sheet feeding direction; an auxiliary nip portion, formed between an outer circumferential surface of the auxiliary driven roller and an outer circumferential surface of the auxiliary drive roller, to nip the recording sheet after toner fixation conveyed from the nip portion; and an outlet guide member, disposed downstream of the auxiliary nip portion in the recording sheet feeding direction, to guide the recording sheet after toner fixation conveyed from the auxiliary nip portion, with the recording sheet bent such that a surface of the recording sheet on which toner fixation has occurred is bent in a concave shape.

These and other objects, features, and advantages of the present invention will become apparent upon consideration of the following description of preferred embodiments of the present invention when taken in conjunction with the accompanying drawings.

DETAILED DESCRIPTION

Hereinafter, an embodiment of the present invention will be described with reference to the drawings.

Figure 1:
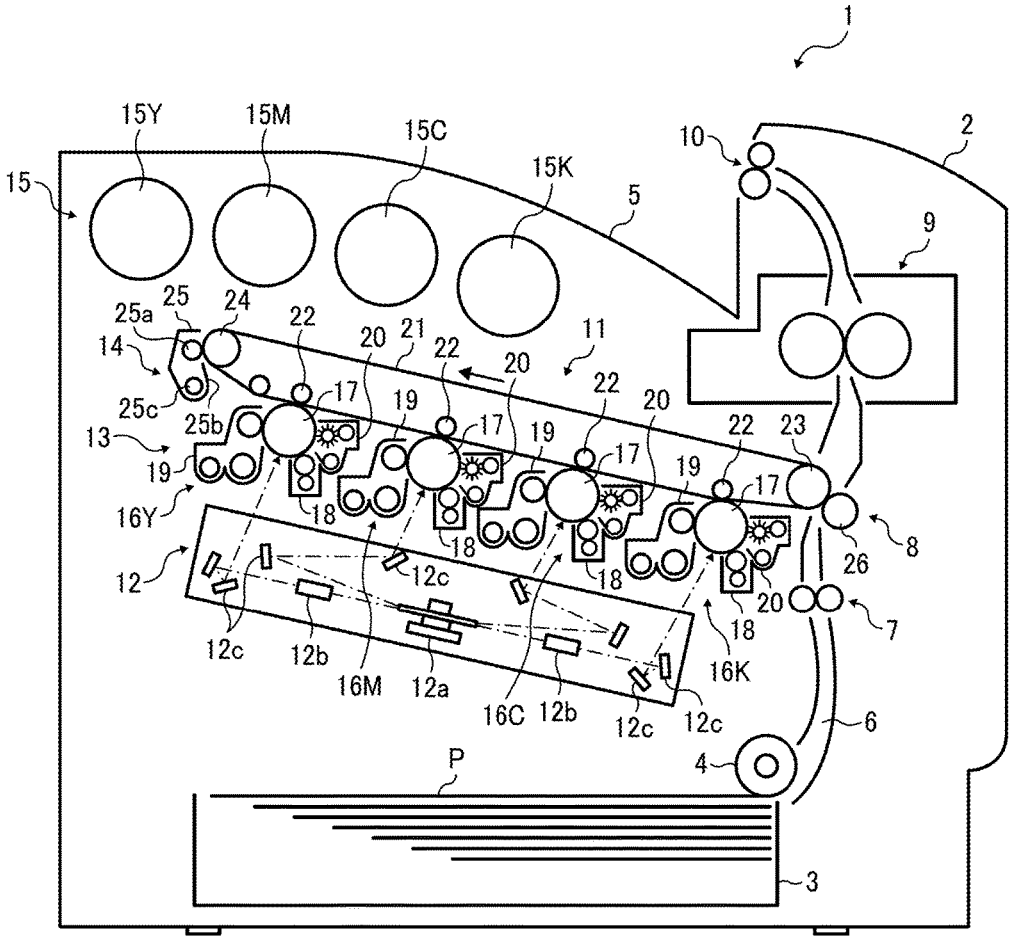
FIG. 1 schematically illustrates an image forming apparatus according to an embodiment of the present invention.

As illustrated in FIG. 1, an image forming apparatus 1 according to the present embodiment is an electrophotographic color laser printer, constructed of a body 2 and a sheet tray 3 disposed in the bottom of the body 2 and designed to accommodate therein a stack of recording sheets P. The image forming apparatus 1 further includes, inside the body 2, a sheet feed roller 4 to convey out and upward a topmost recording sheet P stacked in the sheet tray 3, and a feeding path 6 defined by internal components of the image forming apparatus 1 to feed the recording sheet P sent out via the sheet feed roller 4 toward a sheet ejection tray 5 formed on an upper surface of the body 2 of the image forming apparatus 1.

The image forming apparatus 1 also includes, inside the body 2, a registration roller pair 7, a secondary transfer portion 8, a fixing device 9, and a sheet ejection roller pair 10, disposed, in this order of feeding process along the feeding path 6. The registration roller pair 7 temporarily stops the recording sheet P that has been sent out by the sheet feed roller 4, and again sends the recording sheet P to the secondary transfer portion 8 at a proper timing.

The image forming apparatus 1 yet further includes an image forming section 11 between the sheet tray 3 and the sheet ejection tray 5 inside the body 2. The image forming section 11 includes an exposure unit 12 disposed in the bottom of the body 2, an image forming unit 13 disposed in the middle thereof, and a bottle holder 15 disposed on top of the body 2.

The exposure unit 12 includes a light source, a polygonal mirror 12*a*, an fθ lens 12*b*, a plurality of reflection mirrors 12*c*, and the like, and is configured to irradiate each surface of the photoconductor 17 with laser beams based on image data, to thereby form an electrostatic latent image on the surface of the photoconductor 17.

The image forming section 11 includes four image forming units 16Y, 16M, 16C, and 16K, each having a different color of toner, such as yellow (y), magenta (m), cyan (c), and black (K), that corresponds to color separation components of a color image. These image forming units 16Y, 16M, 16C, and 16K are similarly configured, except that the color of toner each image forming unit handles is different.

Each image forming unit 16Y, 16M, 16C, or 16K includes a drum-shaped photoconductor 17 as an image bearer, and further includes a charger 18, a developing device 19, a cleaning device 20, and a discharger, disposed around the photoconductor 17 in order of an image forming process.

Each charger 18 electrically charges each surface of the photoconductor 17. Each developing device 19 supplies toner to each surface of the photoconductor 17. Each cleaning device 20 cleans each surface of the photoconductor 17.

A transfer unit 14 includes an intermediate transfer belt 21 as an intermediate transfer member, four primary transfer rollers 22 each as a primary transfer member, a secondary transfer backup roller 23 for the secondary transfer portion 8, a tension roller 24, and a belt cleaning device 25.

The intermediate transfer belt 21 is an endless belt stretched around the secondary transfer backup roller 23 and the tension roller 24. When the secondary transfer backup roller 23 rotates, the intermediate transfer belt 21 is driven to rotate in the direction indicated by an arrow in the figure.

Each of the four primary transfer rollers 22 sandwiches the intermediate transfer belt 21 together with each photoconductor 17 included in each of the image forming units 16Y, 16M, 16C, and 16K, to thereby form a primary transfer nip, to which a predetermined amount of voltage is applied from a power source.

The belt cleaning device 25 includes a cleaning brush 25*a* so disposed as to contact the intermediate transfer belt 21, a cleaning blade 25*b* having a leading end that contacts the intermediate transfer belt 21 in a limiting direction, and a collection spiral 25*c*.

The cleaning brush 25*a* and the cleaning blade 25*b* remove paper dust and residual toner adhering to the intermediate transfer belt 21. The collection spiral 25*c* moves removed paper dust and residual toner to the depth of the apparatus and conveys them to a waste toner transfer hose extending from the belt cleaning device 25 to an exterior of the image forming apparatus.

The bottle holder 15 includes four toner bottles 15Y, 15M, 15C, and 15K each containing toner for replenishment. Each toner bottle 15Y, 15M, 15C or 15K is replaceable and supplies toner to a corresponding one developing device 19 disposed in each of the image forming units 16Y, 16M, 16C, and 16K.

The secondary transfer portion 8 includes a secondary transfer roller 26 to sandwich the intermediate transfer belt 21 and the recording sheet P together with the secondary transfer backup roller 23 so as to form a secondary transfer nip. A predetermined amount of voltage is applied to the secondary transfer roller 26 from the power source.

When an image forming operation is started in the image forming apparatus 1, each photoconductor 17 of each image forming unit 16Y, 16M, 16C, or 16K is driven to rotate in the clockwise direction, and each charger 18 charges each surface of the photoconductor 17 evenly at a predetermined polarity.

The exposure unit 12 irradiates the charged surface of each photoconductor 17 with laser beams to form an electrostatic latent image on the surface of each photoconductor 17. In this case, the image data exposed on each photoconductor 17 is monochrome image data decomposed, from the target full-color image, into separate color data of yellow, magenta, cyan, and black.

Each developing device 19 of each of the image forming units 16Y, 16M, 16C, and 16K supplies toner to the surface of the photoconductor 17 and the electrostatic latent image formed on each photoconductor 17 is developed into a visible toner image.

When the image forming operation is started in the image forming apparatus 1, the secondary transfer backup roller 23 rotates in the counterclockwise direction and the intermediate transfer belt 21 is driven to rotate in the direction indicated by an arrow in the figure.

The image forming apparatus 1 applies voltage to each primary transfer roller 22 of the image forming units 16Y, 16M, 16C, and 16K, to thereby form a transfer electric field at the primary transfer nip between each of the primary transfer rollers 22 and each of the photoconductors 17.

Upon the toner image on each of the photoconductor 17 reaching the primary transfer nip with the rotation of each photoconductor 17, the toner image on each photoconductor 17 is sequentially transferred in a superimposed manner on the intermediate transfer belt 21. With this structure, a full-color toner image is borne on the surface of the intermediate transfer belt 21.

The image forming apparatus 1 causes the cleaning device 20 to remove residual toner on the surface of each photoconductor 17 that has not been transferred to the intermediate transfer belt 21, and the discharger to electrically neutralize the surface of the photoconductor 17, and the surface potential is initialized.

The image forming apparatus 1 drives the sheet feed roller 4 to send out a topmost recording sheet P stacked in the sheet tray 3 to feed the recording sheet P to the feeding path 6, and causes the registration roller pair 7 to temporarily stop the recording sheet P fed to the feeding path 6.

Then, the registration roller pair 7 starts to rotate at a predetermined timing so that the recording sheet P is conveyed to the secondary transfer portion 8 at the same time when the toner image on the intermediate transfer belt 21 has reached the secondary transfer nip.

In this case, the transfer voltage having a polarity opposite that of the charged toner of the toner image on the intermediate transfer belt 21 is applied to the secondary transfer portion 8, so that a transfer electric field is formed at the secondary transfer portion 8, by which the toner image on the surface of the intermediate transfer belt 21 is transferred en bloc to the recording sheet P.

The cleaning brush 25*a* and the cleaning blade 25*b* of the belt cleaning device 25 remove residual toner remaining on the surface of the intermediate transfer belt 21 that has not been transferred to the recording sheet P.

The collection spiral 25*c* of the belt cleaning device 25 moves the residual toner that has been removed from the intermediate transfer belt 21 to a distal side in the figure and conveys the waste toner to the waste toner transfer hose extending to an outside.

The image forming apparatus 1 causes the recording sheet P conveyed from the secondary transfer portion 8 to the fixing device 9, that fuses and fixed the toner image onto the recording sheet P, and the sheet ejection roller pair 10 to eject the recording sheet P on which the toner image is fixed, to the sheet ejection tray 5.

The description heretofore relates to an image forming operation when a full-color image is formed on the recording sheet P; however, a monochrome image may be formed using any one of the image forming units 16Y, 16M, 16C, and 16K. Alternatively, an image formed of two or three colors may be possible by using two or three image forming units among the image forming units 16Y, 16M, 16C, and 16K.

Figure 2:
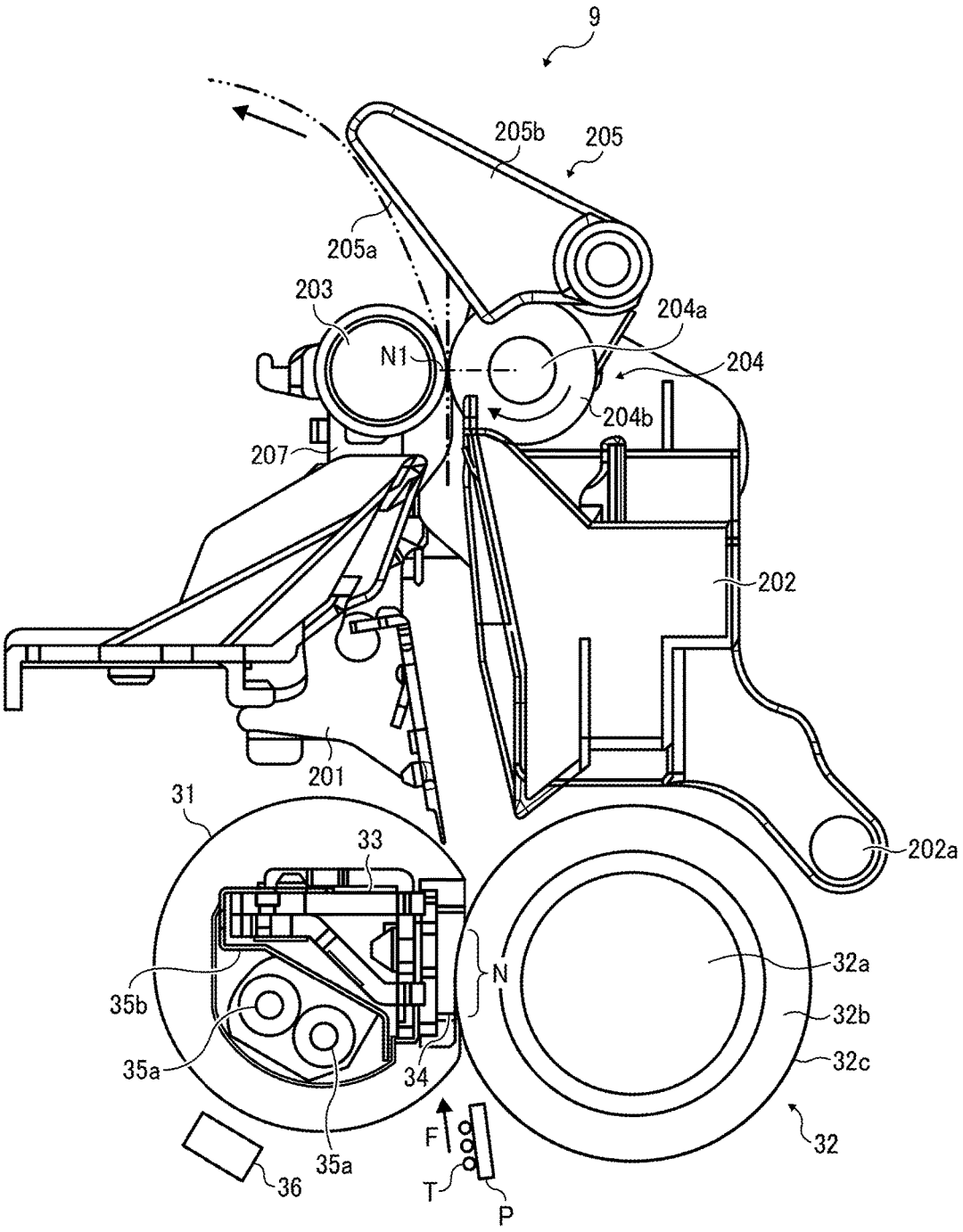
FIG. 2 schematically illustrates a fixing device according to an embodiment of the present invention.

As illustrated in FIG. 2, the fixing device 9 according to the present embodiment includes the endless fixing belt 31 and the pressure roller 32 that contacts an outer circumferential surface of the fixing belt 31. The fixing device 9 further includes a stay 33, a nip forming member 34, and halogen lempas 35*a* and 35*a*, located inside the loop formed by the fixing belt 31.

The fixing belt 31 is a thin, flexible, endless belt, and includes a base material and a release layer disposed on a surface of the base material. Exemplary materials for the base of the fixing belt 31 include metallic materials such as nickel or stainless steel, or resin materials such as polyimide. Examples of materials for the release layer having a releasability relative to the toner include copolymer of tetrafluoroethylene-perfluoroalkyl vinylether (PFA) or polytetrafluoroethylene (PTFE).

Optionally, an elastic layer formed of silicon rubber may be disposed between the base and the release layer. If the fixing belt 31 does not include an elastic layer, the thermal capacity of the fixing belt 31 declines and fixing property of toner T is improved. However, when the unfixed toner T is pressed and fixed, minute concavities and convexities of the belt surface are transferred to the toner image, and the solid image portion may include unevenness (the so-called "orange peel effect").

If the fixing belt 31 includes an elastic layer having a depth of 100 μm or more between the base member and the release layer, the minute concavity and convexity on the surface of the belt are absorbed due to deformation of the elastic layer and the orange-peel-like surface of the image in the image solid portion can be improved.

The pressure roller 32 includes a metal core 32*a*, an elastic layer 32*b* formed on the surface of the metal core 32*a*, and a release layer 32*c* formed on the surface of the elastic layer 32*b*. Exemplary materials for the metal core 32*a* of the pressure roller 32 include metallic materials such as iron or stainless steel; and materials for the elastic layer 32*b* include resin materials such as foamed silicon rubber, silicon rubber, or fluoro-rubber; and the release layer 32*c* employs resin materials such as PFA or PTFE.

The pressure roller 32 is rotatably attached to the body 2 (see FIG. 1) of the apparatus, and extends parallel to an axis of the fixing belt 31 so that the outer circumferential surface of the pressure roller 32 contacts the outer circumferential surface of the fixing belt 31. Further, the pressure roller 32 is configured to be rotated by a motor. In the present embodiment, the pressure roller 32 is configured as a solid-core roller, but may be a hollow roller.

The stay 33 extends parallel to the axis of the fixing belt 31 to pass through the fixing belt 31 and is supported by the body 2 of the apparatus.

The nip forming member 34 presses the fixing belt 31 against the outer circumferential surface of the pressure roller 32 from an inner circumferential surface of the fixing belt 31. A low-friction sliding sheet is disposed on the nip forming member 34 at a portion contacting the inner circumferential surface of the fixing belt 31.

In addition, the pressure roller 32 is pressed toward the nip forming member 34 by a biasing member, so that the outer circumferential surface of the pressure roller 32 contacts the outer circumferential surface of the fixing belt 31, and the elastic layer 32*b* is squeezed.

With this structure, a band-like nip portion N with a predetermined width extending in the axial direction of the fixing belt 31 and the pressure roller 32 is formed in the fixing device 9 at a portion where the fixing belt 31 and the pressure roller 32 contact each other. In addition, in the fixing device 9, when the pressure roller 32 is driven to rotate, the fixing belt 31 rotates following the pressure roller 32, and the recording sheet P entering the nip portion N is conveyed in a direction indicated by arrow F in FIG. 2.

The heater 35, a heating device to heat the fixing belt 31, includes a plurality of halogen lamps 35*a*, and a reflection member 35*b* to reflect light radiated by the halogen lamps 35*a* to an inner circumferential surface of the fixing belt 31. Preferably, the reflection member 35*b* requires a high heat resistance and is formed of metallic materials such as aluminum, iron, or stainless steel.

The fixing device 9 includes a temperature sensor 36, to detect a temperature of the fixing belt 31, disposed on a side where the recording sheet P enters the nip portion. The fixing device 9 controls the heater 35 based on the detected value of the temperature sensor 36 in a feedback manner to maintain the fixing belt 31 at a temperature suitable for fusing and fixing the toner T relative to the recording sheet P.

In the fixing device 9, when the pressure roller 32 rotates, the fixing belt 31 rotates following the rotation of the pressure roller 32. In the fixing device 9, when the fixing belt 31 is heated by the heater 35, the pressure roller 32 rotates, and the fixing belt 31 cyclically moves, the recording sheet P on which a toner image is transferred, passes through the nip N, and then the toner image is fused and fixed onto the recording sheet P.

The fixing device 9 includes a belt-side separator feeder 201 and a roller-side separator feeder 202 disposed downstream of the fixing belt 31 and the pressure roller 32 in the recording sheet feeding direction.

The belt-side separator feeder 201 formed of a metal material, has a leading end portion, which contacts the outer circumferential surface of the fixing belt 31 to separate the recording sheet P that tends to adhere to the outer circumferential surface of the fixing belt 31, so that the recording sheet P is securely peeled off from the fixing belt 31.

The roller-side separator feeder 202, formed of a resin material, includes a base end including a rod 202*a* that extends in an axial direction of the fixing belt 31. The base end is supported by the body 2 of the apparatus via the rod 202*a*, and the roller-side separator feeder 202 is configured to oscillate between a position closing to the pressure roller 32 and a position separating from the pressure roller 32.

The roller-side separator feeder 202 can be oscillated to a position separating from the pressure roller 32 when a paper jam of the recording sheet P occurs in the nip portion N, and the user can pull out the recording sheet P manually by hand.

Figure 3:
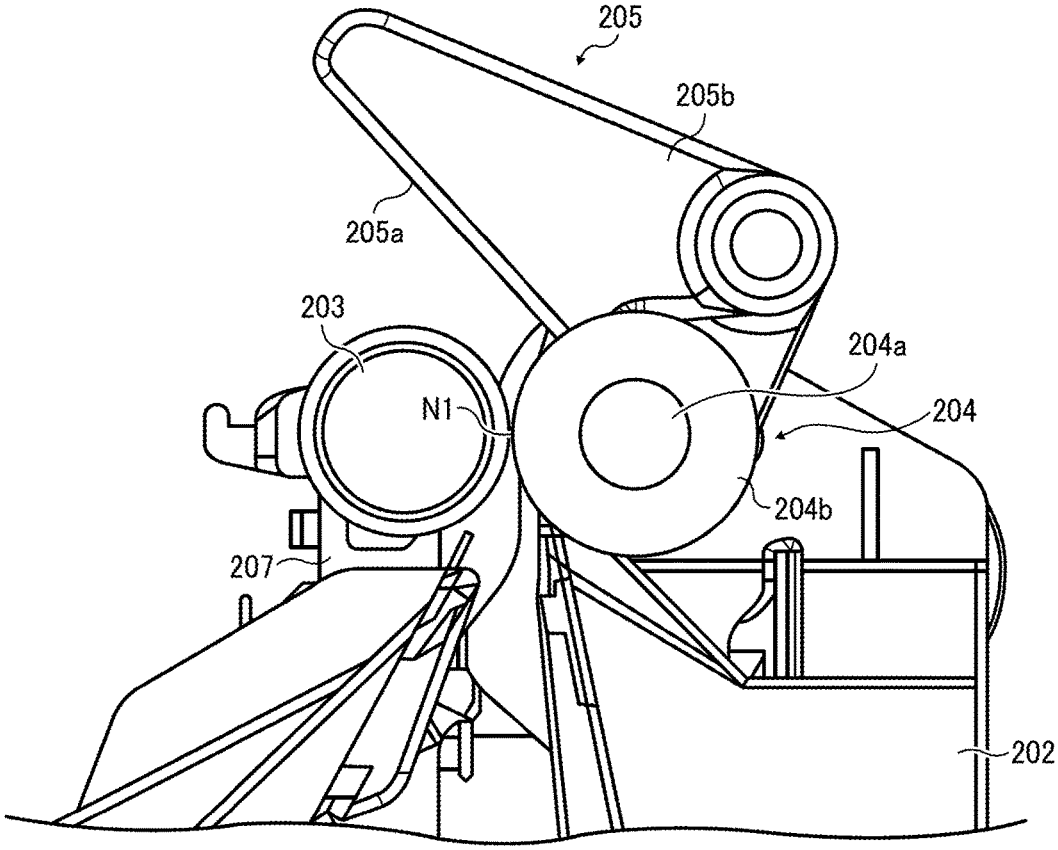
FIG. 3 schematically illustrates an auxiliary driven roller, an auxiliary drive roller, and an outlet guide member as illustrated in FIG. 2.

As illustrated in FIGS. 2 and 3, the fixing device 9 according to the present embodiment further includes an auxiliary driven roller 203, an auxiliary drive roller 204, and an outlet guide member 205, all of which are disposed downstream in the recording sheet feeding direction of the belt-side separator feeder 201 and the roller-side separator feeder 202.

The auxiliary driven roller 203 extends parallel to the axis of the fixing belt 31 and is rotatably attached to a holder 207 disposed on the belt-side separator feeder 201. The holder 207 is biased toward the feeding path of the recording sheet P via a spring.

The auxiliary driven roller 203 is constructed of a hollow metal core and a release layer with a depth of from 30 to 300 μm formed on the surface of the metal core, and has an even outer diameter along the entire length. Exemplary materials for the metal core of the auxiliary driven roller 203 include metallic materials such as iron or stainless steel. The release layer, as a surface layer, employs resin materials such as PFA or PTFE.

The auxiliary drive roller 204 also extends parallel to the axis of the fixing belt 31, is rotatably attached to the roller-side separator feeder 202, and is driven by the motor.

Figure 4:
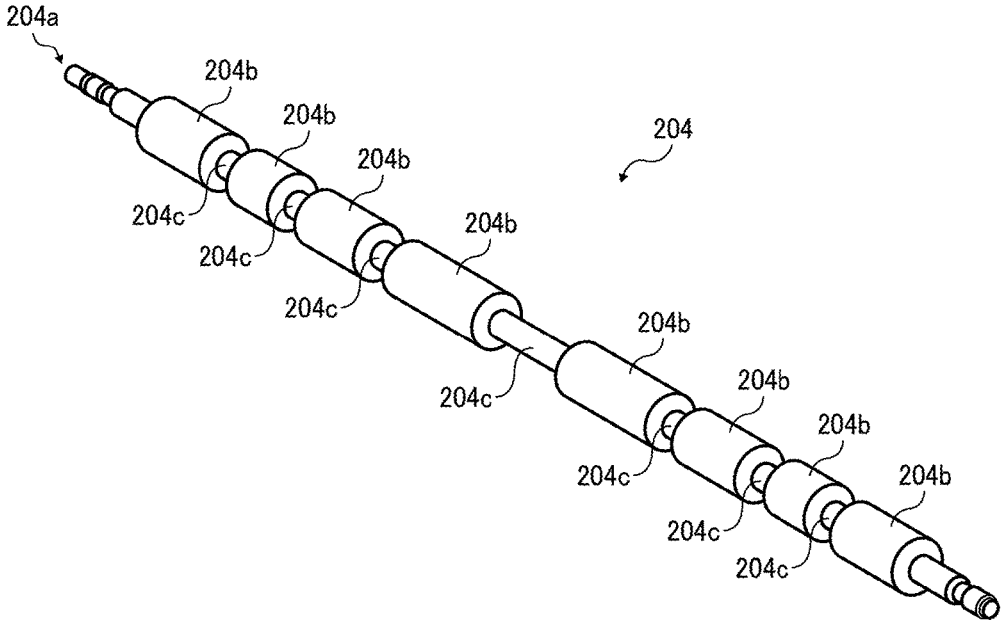
FIG. 4 is a perspective view of the auxiliary drive roller as illustrated in FIG. 2.

As illustrated in FIG. 4, the auxiliary drive roller 204 includes a shaft 204*a* formed of metallic materials such as aluminum, iron, or stainless steel, and a plurality of rollers 204*b* having the same outer diameter and mounted to the shaft 204*a* at intervals along the shaft 204*a*. Specifically, the auxiliary drive roller 204 does not have an even outer diameter along the entire length, but includes stepped portions 204*c* of reduced diameter, at which the outer diameter thereof is less than that of the rollers 204*b* are disposed.

The rollers 204*b* are constructed of a hollow metal core and a grip layer formed on the surface of the metal core. The metal core may be formed of metallic materials such as aluminum, iron, or stainless steel; and a grip layer formed of solid rubber materials such as silicon, EPDM, urethane, and fluorine rubber having a higher wear coefficient to obtain a higher recording sheet feeding property.

An outer circumferential surface of the rollers 204*b* of the auxiliary drive roller 204 contacts an outer circumferential surface of the auxiliary driven roller 203 pressed toward the feeding path of the recording sheet P via a spring.

With this structure, in the fixing device 9, an auxiliary nip portion N1 to sandwich the recording sheet P of which toner fixation has been completed is formed at a portion where the auxiliary driven roller 203 and the auxiliary drive roller 204 contact each other. In addition, in the fixing device 9, when the auxiliary drive roller 204 is driven, the auxiliary driven roller 203 is driven to rotate following the auxiliary drive roller 204, and the recording sheet P entering the auxiliary nip portion N1 is conveyed downstream in the recording sheet feeding direction.

Figure 5:
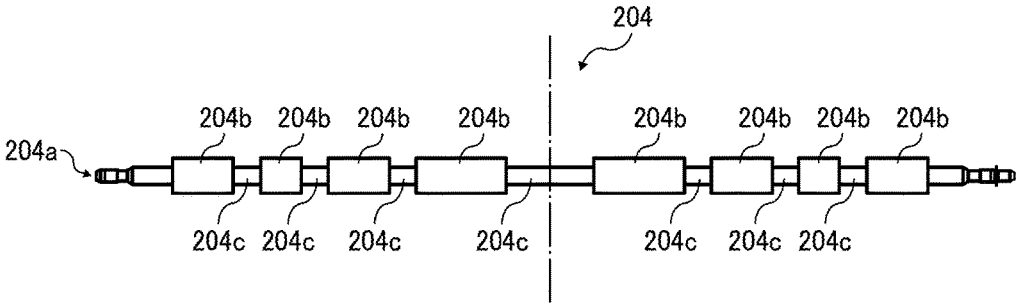
FIG. 5 is a plan view of the auxiliary drive roller as illustrated in FIG. 2.

As illustrated in FIG. 5, the plurality of rollers 204*b* of the auxiliary drive roller 204 is symmetrically formed with a center of the shaft 204*a* set as a center of the recording sheet feeding path, and is formed such that both ends of the recording sheets P of various sizes contact an outer circumferential surface of at least some of the plurality of rollers 204*b*. With this structure, in the fixing device 9, both ends of the recording sheet P of various sizes are nipped in the auxiliary nip portion N1 by the auxiliary driven roller 203 and at least some of the rollers 204*b* of the auxiliary drive roller 204.

Figure 6:
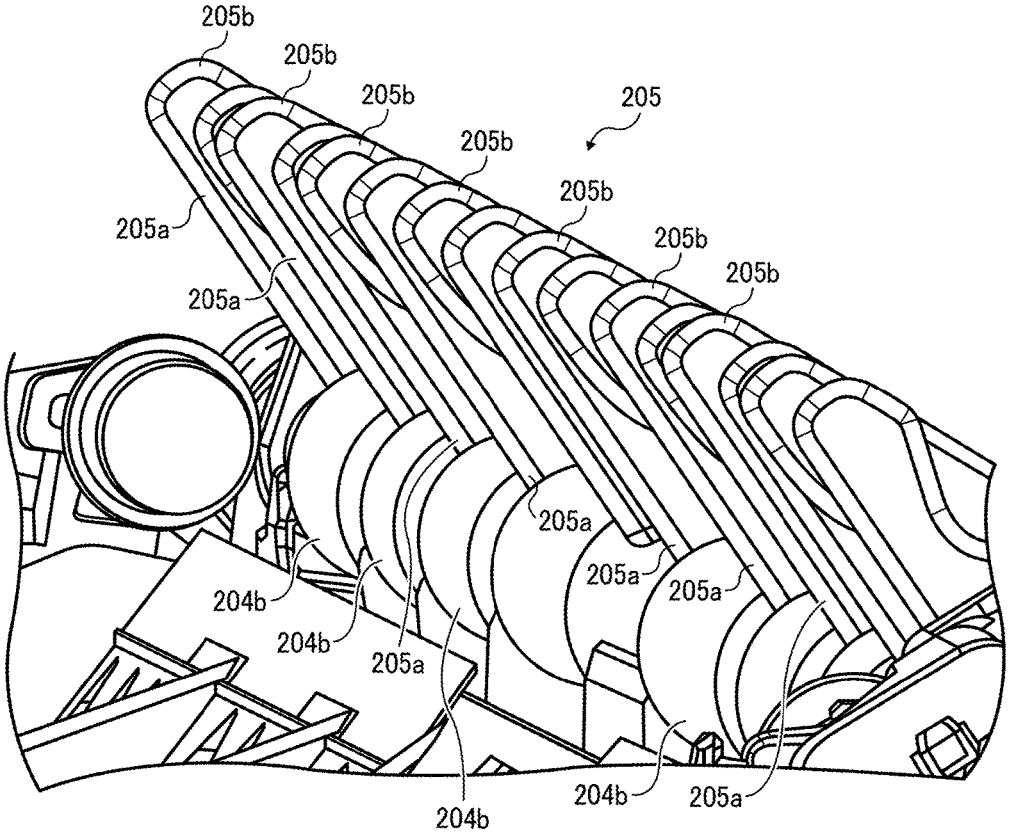
FIG. 6 is a partial, perspective view of the auxiliary drive roller and the outlet guide member as illustrated in in FIG. 2.

As illustrated in FIG. 6, the outlet guide member 205, attached to the roller-side separator feeder 202, includes guide surfaces 205*a* opposing to the auxiliary nip portion N1 from above and a plurality of ribs 205*b* coming into each of the stepped portions 204*c* between the plurality of roller 204*b*. The plurality of ribs 205*b* fills the plurality of stepped portions 204*c* so as not to interfere with the rotation operation of the plurality of rollers 204*b*.

The outlet guide member 205 is disposed such that the guide surfaces 205*a* each have an upward slope from a lower side to an upper side to the auxiliary driven roller 203. In addition, as illustrated in FIG. 3, the outlet guide member 205 is preferably disposed with a space of 10 mm or less between the auxiliary nip portion N1 and the guide surfaces 205*a*.

With this structure, in the fixing device 9, the leading end of the recording sheet P conveyed from the auxiliary nip portion N1 contacts the guide surfaces 205*a* of the outlet guide member 205 to be led to the auxiliary driven roller 203, and the recording sheet P after toner fixation is bent sideways. Specifically, the recording sheet P after toner fixation is guided with the concavely-bent toner fixation surface.

The fixing device 9 and the image forming apparatus 1 according to the present embodiment include the outlet guide member 205 disposed downstream of the auxiliary nip portion N1 in the recording sheet feeding direction, to guide the recording sheet P ejected from the auxiliary nip portion N1 after the toner fixation with the toner fixation surface bent in the concave shape.

As a result, the fixing device 9 and the image forming apparatus 1 according to the present embodiment feed the recording sheet P with a large curl toward a surface with no image, while correcting the curl by the guide surfaces 205*a* of the outlet guide member 205, to the sheet ejection roller pair 10 and the sheet ejection tray 5 of the image forming apparatus 1. Therefore, the fixing device 9 and the image forming apparatus 1 according to the present embodiment reduce an amount of curl in the recording sheet P and helps prevent paper jams in the feeding path 6 and the sheet ejection outlet.

The fixing device 9 and the image forming apparatus 1 according to the present embodiment include the outlet guide member 205 that includes the plurality of ribs 205*b*, which come into the plurality of stepped portions 204*c* formed in the auxiliary drive roller 204. Therefore, the fixing device 9 and the image forming apparatus 1 according to the present embodiment allow the recording sheet P ejected from the auxiliary nip portion N1 not to be caught on the ribs 205*b*, thereby helping to prevent paper jams from occurring in the fixing device 9.

The fixing device 9 and the image forming apparatus 1 according to the present embodiment include a release layer as a surface layer of the auxiliary driven roller 203, formed of resin materials such as PFA or PTFE.

Therefore, the fixing device 9 and the image forming apparatus 1 according to the present embodiment are capable of preventing unfused toner T remaining on the recording sheet P during the toner fixation from adhering to the auxiliary driven roller 203. Therefore, the fixing device 9 and the image forming apparatus 1 according to the present embodiment are capable of preventing contamination of the recording sheet P due to unfused toner T accumulated on the auxiliary driven roller 203.

The fixing device 9 and the image forming apparatus 1 according to the present embodiment include the auxiliary driven roller 203 having an even outer diameter along the entire length thereof, and are formed such that both ends of the recording sheets P conveyed from the nip portion N contact an outer circumferential surface of at least some of the plurality of rollers 204*b*.

With this structure, in the fixing device 9 and the image forming apparatus 1, both ends of the recording sheet P of various sizes are nipped in the auxiliary nip portion N1 by the auxiliary driven roller 203 and any of the rollers 204*b* of the auxiliary drive roller 204. Therefore, in the fixing device 9 and the image forming apparatus 1 according to the present embodiment, the outlet guide member 205 effectively reduces an amount of curl in the recording sheet P without loosening both edge portions of the recording sheet P.

In the fixing device 9 and the image forming apparatus 1 according to the present embodiment, the outlet guide member 205 is preferably positioned with a space of 10 mm or less between the auxiliary nip portion N1 and the guide surfaces 205*a*.

Therefore, in the fixing device 9 and the image forming apparatus 1 according to the present embodiment, the outlet guide member 205 can fully bend the recording sheet P, to thereby provide excellent curl correction.

As described heretofore, the fixing device and the image forming apparatus according to the present invention effectively reduce a curl of the recording sheet due to fixation of toner images.

Additional modifications and variations of the present invention are possible in light of the above teachings. It is therefore to be understood that, within the scope of the appended claims, the invention may be practiced other than as specifically described herein.

What is claimed is:

1. A fixing device comprising:

an endless fixing belt;

a pressure roller configured to contact an outer circumferential surface of the fixing belt;

a nip forming member configured to press the fixing belt against an outer circumferential surface of the pressure roller from an inner circumferential surface of the fixing belt;

a nip portion formed between the outer circumferential surface of the fixing belt and the outer circumferential surface of the pressure roller;

a heater configured to heat the fixing belt to fuse and fix toner onto a recording sheet in the nip portion;

an auxiliary driven roller, downstream of the nip portion in a recording sheet feeding direction;

an auxiliary drive roller configured to drive the driven roller, downstream of the nip portion in the recording sheet feeding direction;

an auxiliary nip portion, formed between an outer circumferential surface of the auxiliary driven roller and an outer circumferential surface of the auxiliary drive roller, configured to nip the recording sheet after toner fixation conveyed from the nip portion; and an outlet guide member, downstream of the auxiliary nip portion in the recording sheet feeding direction, configured to guide the recording sheet after toner fixation conveyed from the auxiliary nip portion, with the recording sheet bent such that a surface of the recording sheet on which toner fixation has occurred is bent in a concave shape, wherein the auxiliary drive roller includes a plurality of rollers and a plurality of stepped portions between the plurality of rollers, the plurality of rollers having varying horizontal width in an axial direction thereof;

wherein the outlet guide member includes a plurality of ribs having guide surfaces that oppose the auxiliary nip portion, the plurality of ribs are interleaved between the plurality of stepped portions, and wherein the auxiliary drive roller continuously extend in an axial direction substantially along an entire width direction of the recording sheet.

2. The fixing device according to claim 1, wherein the auxiliary driven roller includes a surface layer made of a material with recording-sheet releasability.

3. The fixing device according to claim 1, wherein the auxiliary drive roller further includes a shaft, wherein the plurality of rollers have a same outer diameter disposed along the shaft at set intervals, and the plurality of stepped portions are between the plurality of rollers and have an outer diameter smaller than a diameter of the plurality of rollers; and wherein both lateral ends of the recording sheet ejected from the auxiliary nip portion contact an outer circumferential surface of at least some of the plurality of rollers.

4. The fixing device according to claim 1, wherein the outlet guide member is positioned with a space of 10 mm or less between the auxiliary nip portion and guide faces of the outlet guide member.

5. The fixing device according to claim 1, further comprising a separator located between the nip portion and the auxiliary nip portion, wherein the separator includes a belt-side separator and a roller-side separator.

6. The fixing device according to claim 5, wherein the belt-side separator includes a leading end portion, which contacts the outer circumferential surface of the fixing belt to separate the recording sheet that tends to adhere to the outer circumferential surface of the fixing belt, so that the recording sheet is securely peeled off from the fixing belt.

7. The fixing device according to claim 5, wherein the belt-side separator is formed of a metal material.

8. The fixing device according to claim 5, wherein the roller-side separator includes a base end including a rod that extends in an axial direction of the fixing belt.

9. The fixing device according to claim 8, wherein the base end is supported by a body of an apparatus via the rod, and the roller-side separator is configured to oscillate between a position closing to the pressure roller and a position separating from the pressure roller.

10. The fixing device according to claim 8, wherein the roller-side separator is configured to oscillate to a position separating from the pressure roller when a paper jam of the recording sheet occurs in the nip portion and a user pulls out the recording sheet manually by hand.

11. The fixing device according to claim 5, wherein the roller-side separator is formed of a resin material.

12. The fixing device according to claim 5, wherein the auxiliary driven roller is configured to extend parallel to an axis of the fixing belt and is rotatably attached to a holder located on the belt-side separator.

13. The fixing device according to claim 5, wherein the auxiliary drive roller is configured to extend parallel to an axis of the fixing belt and is rotatably attached to the roller-side separator.

14. The fixing device according to claim 5, wherein the outlet guide member, attached to the separator, includes the guide surfaces that oppose the auxiliary nip portion from above and the plurality of ribs fill each of a plurality of stepped portions between a plurality of rollers.

15. The fixing device according to claim 14, wherein the plurality of ribs are configured to fill the plurality of stepped portions so as not to interfere with a rotation operation of the plurality of rollers.

16. The fixing device according to claim 1, wherein the outlet guide member includes guide surfaces, each of the guide surfaces has an upward slope from a lower side to an upper side in relation to the auxiliary driven roller.

17. The fixing device according to claim 1, wherein the plurality of ribs are interleaved between the plurality of stepped portions formed in the auxiliary drive roller.

18. The fixing device according to claim 1, wherein the auxiliary driven roller has the same outer diameter along an entire length thereof, and is formed such that both ends of the recording sheets conveyed from the nip portion contact the guide surfaces of the plurality of ribs.

19. An image forming apparatus comprising:

a fixing device including:

an endless fixing belt;

a pressure roller configured to contact an outer circumferential surface of the fixing belt;

a nip forming member configured to press the fixing belt against an outer circumferential surface of the pressure roller from an inner circumferential surface of the fixing belt;

a nip portion formed between the outer circumferential surface of the fixing belt and the outer circumferential surface of the pressure roller;

a heater configured to heat the fixing belt to fuse and fix toner onto a recording sheet in the nip portion;

an auxiliary driven roller, downstream of the nip portion in a recording sheet feeding direction;

an auxiliary drive roller configured to drive the driven roller, disposed downstream of the nip portion in the recording sheet feeding direction;

an auxiliary nip portion, formed between an outer circumferential surface of the auxiliary driven roller and an outer circumferential surface of the auxiliary drive roller, configured to nip the recording sheet after toner fixation conveyed from the nip portion; and an outlet guide member, downstream of the auxiliary nip'portion in the recording sheet feeding direction, configured to guide the recording sheet after toner fixation conveyed from the auxiliary nip portion, with the recording sheet bent such that a surface of the recording sheet on which toner fixation has occurred is bent in a concave shape, wherein the auxiliary drive roller includes a plurality of rollers and a plurality of stepped portions between the plurality of rollers, the plurality of rollers having varying horizontal width in an axial direction thereof;

wherein the outlet guide member includes a plurality of ribs having guide surfaces that oppose the auxiliary nip portion, the plurality of ribs are interleaved between the plurality of stepped portions, and wherein the auxiliary drive roller continuously extend in an axial direction substantially along an entire width direction of the recording sheet.

* * * * *